US010526745B2

(12) United States Patent
Dunn et al.

(10) Patent No.: US 10,526,745 B2
(45) Date of Patent: Jan. 7, 2020

(54) DOOR FOR IMPROVED AIR FLOW IN A DRYER APPLIANCE

(71) Applicant: Haier US Appliance Solutions, Inc., Wilmington, DE (US)

(72) Inventors: David Scott Dunn, Smithfield, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 11 days.

(21) Appl. No.: 15/956,810

(22) Filed: Apr. 19, 2018

(65) Prior Publication Data

US 2019/0323163 A1 Oct. 24, 2019

(51) Int. Cl.

| | |
|---|---|
| ***D06F 58/22*** | (2006.01) |
| ***D06F 58/04*** | (2006.01) |
| ***D06F 58/28*** | (2006.01) |

(52) U.S. Cl.

CPC ..... *D06F 58/22* (2013.01); *D06F 58/04* (2013.01); *D06F 2058/2841* (2013.01)

(58) Field of Classification Search

CPC .... D06F 58/22; D06F 58/04; D06F 2058/241; D06F 58/28

USPC ..... 34/595–610

See application file for complete search history.

(56) References Cited

U.S. PATENT DOCUMENTS

| | | | | |
|---|---|---|---|---|
| 2,675,628 A | | 4/1954 | O'Neil | |
| 2,752,694 A | * | 7/1956 | McCormick | D06F 58/02 34/60 |
| 2,886,901 A | | 5/1959 | Whyte et al. | |
| 2,996,809 A | | 8/1961 | Shapter | |
| 3,043,015 A | | 7/1962 | Brucken | |
| 3,099,542 A | | 7/1963 | Van Scoyk | |
| 3,805,404 A | * | 4/1974 | Gould | D06F 58/04 34/75 |
| 7,171,761 B1 | * | 2/2007 | Hunts | D06F 58/10 219/400 |
| 8,572,865 B2 | * | 11/2013 | Beers | D06F 58/04 237/2 B |
| 9,115,461 B2 | * | 8/2015 | Anderson | D06F 37/28 |
| 2017/0306551 A1 | * | 10/2017 | Kim | D06F 39/022 |
| 2019/0010650 A1 | * | 1/2019 | Xu | D06F 37/10 |
| 2019/0145041 A1 | * | 5/2019 | Bhandare | D06F 39/005 |
| 2019/0145043 A1 | * | 5/2019 | Beers | D06F 58/206 |
| 2019/0153659 A1 | * | 5/2019 | Prajescu | D06F 58/28 |
| 2019/0211489 A1 | * | 7/2019 | An | D06F 33/02 |

FOREIGN PATENT DOCUMENTS

| | | | | |
|---|---|---|---|---|
| CN | 203834237 U | | 9/2014 | |
| DE | 102012110179 A1 | * | 6/2013 | D06F 39/02 |
| EP | 1837434 A1 | | 9/2007 | |

* cited by examiner

*Primary Examiner* — Stephen M Gravini

(74) *Attorney, Agent, or Firm* — Dority & Manning, P.A.

(57) ABSTRACT

A door of a dryer appliance includes a frame defining a distribution plenum surrounding a transparent window. The frame defines a plurality of inlets on an inner surface and being spaced circumferentially around the frame to provide fluid communication between a drying chamber and the distribution plenum. A plenum outlet provides fluid communication between the distribution plenum and a trap duct for permitting the discharge of heated air from the drying chamber.

20 Claims, 6 Drawing Sheets

DOOR FOR IMPROVED AIR FLOW IN A DRYER APPLIANCE

FIELD OF THE INVENTION

The present subject matter relates generally to dryer appliances, and more particularly to doors having features for improving the air flow and reducing the likelihood of clogs in dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance. Dryer appliances may further include filter systems for removing foreign materials, such as lint, from passing into the exhaust conduit, which can impair dryer performance and may present a fire hazard due to the potential for combustion.

In general, increasing the flow rate of heated air within a dryer appliance can improve dryer performance and result in lower drying times and energy costs. However, there is a practical limit to these flow rates in conventional dryers, because high flow velocities push articles of clothing toward an outlet of the chamber. In addition, the suction generated at the outlet traps the articles of clothing, clogging the outlet and choking the flow of air. As a result of the choked air, high temperatures may be generated within the dryer appliance, the heating elements may be repeatedly cycled, the dry time may be increased, and dryer performance and efficiency are decreased.

Accordingly, improved dryer appliances including features for improved air flow are desirable. More specifically, dryer appliances including features that improve the volumetric flow rate of heated air while reducing the likelihood of clogs in the air flow path would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided including a cabinet and a drum rotatably mounted within the cabinet, the drum defining a chamber for receipt of clothes for drying. A front bulkhead defines a bypass aperture and an opening for accessing the chamber and a door is pivotally mounted to the cabinet over the opening to provide selective access to the chamber. The door includes a frame defining an inner surface and a distribution plenum and a plurality of inlets defined on the inner surface for providing fluid communication between the chamber and the distribution plenum. A plenum outlet is defined on the inner surface for providing fluid communication between the distribution plenum and the bypass aperture and a transparent window is positioned within the frame.

In another aspect of the present disclosure, a door of a dryer appliance is provided. The dryer appliance includes a drum defining a chamber for receipt of clothes for drying and a front bulkhead defining a bypass aperture and an opening for accessing the chamber. The door includes a frame defining an inner surface and a distribution plenum and a plurality of inlets defined on the inner surface for providing fluid communication between the chamber and the distribution plenum. A plenum outlet is defined on the inner surface for providing fluid communication between the distribution plenum and the bypass aperture and a transparent window is positioned within the frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
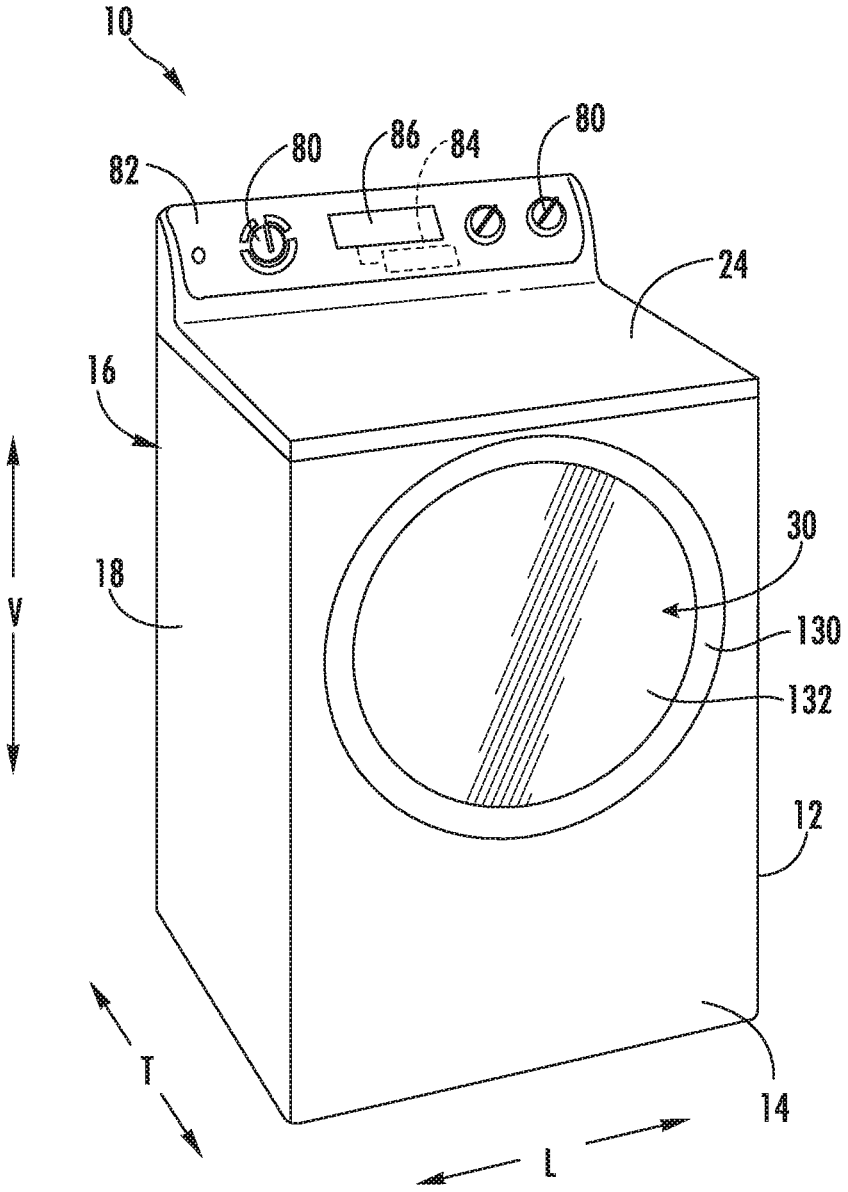
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
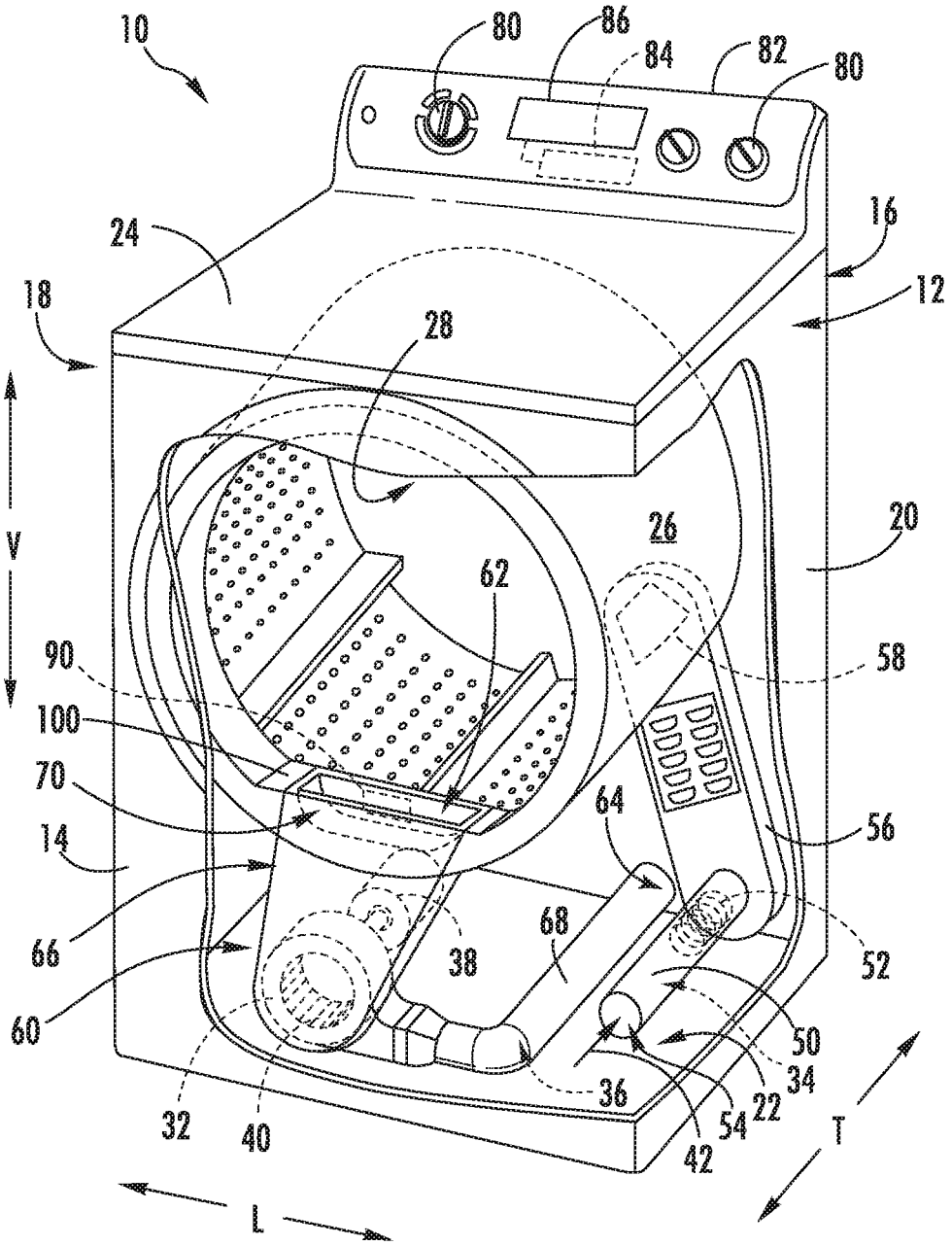
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow through an entrance air passage 34 and an air exhaust passage 36 (which is generally defined within trap duct 66, exhaust conduit 68, and dryer discharge port 64). Specifically, air handler 32 may include a motor 38 which may be in mechanical communication with a blower fan 40, such that motor 38 rotates blower fan 40. In this manner, air handler 32 is configured for drawing a flow of heated air (indicated by reference numeral 42 in FIGS. 2 through 4) through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air 42 that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, air handler 32 urges ambient air 42 into air entrance passage 34 defined by heating assembly 50 via an entrance 54. Such ambient air is heated within heating assembly 50 and exits heating assembly 50 as flow of heated air 42. Air handler 32 draws such heated air 42 from air entrance passage 34, through inlet duct 56, and into drum 26. The heated air enters drum 26 through an outlet of duct 56, otherwise referred to herein as a chamber inlet 58, positioned at a rear wall of drum 26.

Within chamber 28, the heated air can remove moisture, e.g., from damp articles disposed within chamber 28. This flow of heated air 42 then flows from chamber 28 through an outlet assembly 60 positioned within cabinet 12. Outlet assembly 60 generally defines air exhaust passage 36 that extends between a chamber outlet 62 and a dryer discharge port 64 defined in rear panel 16 of cabinet 12. Specifically, outlet assembly 60 generally includes a trap duct 66 that extends between chamber outlet 62 and air handler 32, and an exhaust conduit 68 that extends between air handler 32 and dryer discharge port 64. During a dry cycle, the flow of heated air 42 from chamber 28 passes through trap duct 66 to air handler 32 and through exhaust conduit 68 where it is discharged through dryer discharge port 64.

According to exemplary embodiments, an external duct (not shown) is in fluid communication with dryer discharge port 64. For instance, the external duct may be attached (e.g., directly or indirectly attached) to cabinet 12 at rear panel using any suitable connector (e.g., collar, clamp, etc.). In residential environments, the external duct may be in fluid communication with an outdoor environment (e.g., outside of a home or building in which dryer appliance 10 is installed). During a dry cycle, internal air may thus flow from exhaust conduit 68 and through the external duct before being exhausted to the outdoor environment.

In exemplary embodiments, trap duct 66 may include a filter portion 70 which includes a screen filter or other suitable device for removing lint and other particulates as internal air is drawn out of chamber 28. The internal air is drawn through filter portion 70 by air handler 32 before being passed through exhaust conduit 68. After the clothing articles have been dried (or a drying cycle is otherwise completed), the clothing articles are removed from drum 26, e.g., by accessing chamber 28 by opening door 30. The filter portion 70 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance 10. For example, dryer appliance 10 may include one or more temperature sensors 90. Temperature sensor 90 is generally operable to measure internal temperatures in dryer appliance 10. In some embodiments, temperature sensor 90 is disposed proximal to chamber outlet 62 of drum 26 (e.g., within trap duct 66). In additional or alternative embodiments, a temperature sensor 90 is disposed within exhaust conduit 68, or otherwise in thermal communication therewith. For example, temperature sensor 90 may extend at least partially within exhaust passage 36 to measure the temperature of air therethrough. In further additional or alternative embodiments, a temperature sensor 90 may be disposed at any other suitable location within dryer appliance 10 to detect the temperature of the flow of heated air 42 (e.g., downstream from chamber 28). Temperature sensor 90 may be a thermistor, thermocouple, or any other suitable sensor for detecting a specific temperature value of air within appliance 10. When assembled, temperature sensor 90 may be in communication with (e.g., electrically coupled to) controller 84, and may transmit readings to controller 84 as required or desired.

In some embodiments, controller 84 is configured to vary operation of heating assembly 50 based on one or more temperatures detected at temperature sensor 90. For instance, controller 84 may automatically set or adjust one or more criteria for activation heating assembly 50 without an estimation of ambient conditions by a user. Specifically, controller 84 may determine an ambient temperature and set or adjust a threshold criterion accordingly. During use, controller 84 can initiate a temperature-contingent dryer cycle wherein a determination about the ambient conditions (e.g., ambient air temperature) is made, and operation of the appliance 10 is modified accordingly.

Referring now to FIGS. 3 through 6, outlet assembly 60 and door 30 will be described in more detail according to exemplary embodiments of the present subject matter. Specifically, aspects of door 30 and outlet assembly 60 which facilitate the improved flow of air 42 through chamber 28 will be described. Generally speaking, this is achieved according to exemplary embodiments by providing alternate pathways for the flow of air 42 to pass from chamber 28 into exhaust passage 36, thereby reducing the likelihood of articles of clothing clogging chamber outlet 62 and preventing the flow of air through chamber 28.

Figure 3:
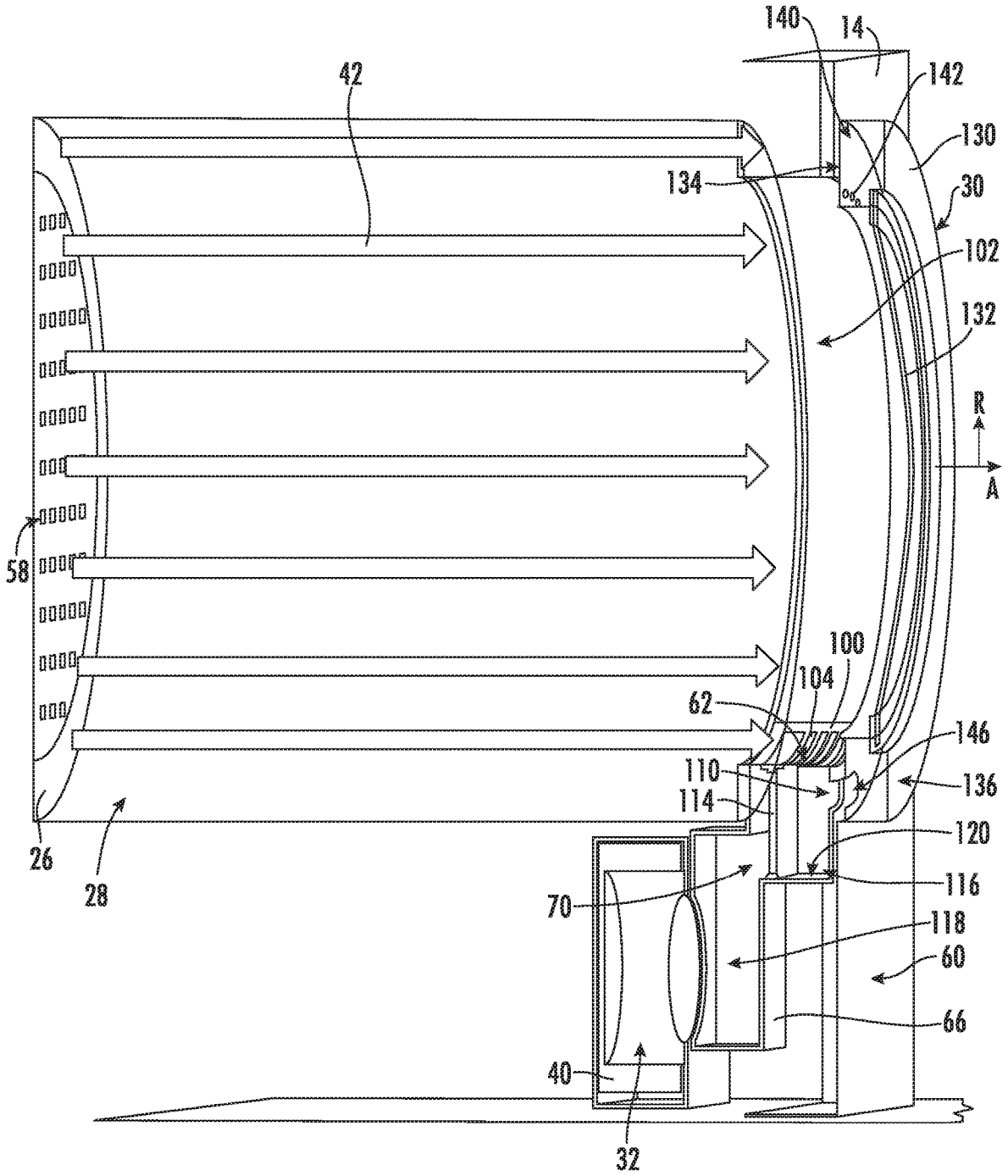
FIG. 3 provides a schematic cross sectional view of a drum of the exemplary dryer appliance of FIG. 1 according to an exemplary embodiment of the present subject matter.
Figure 4:
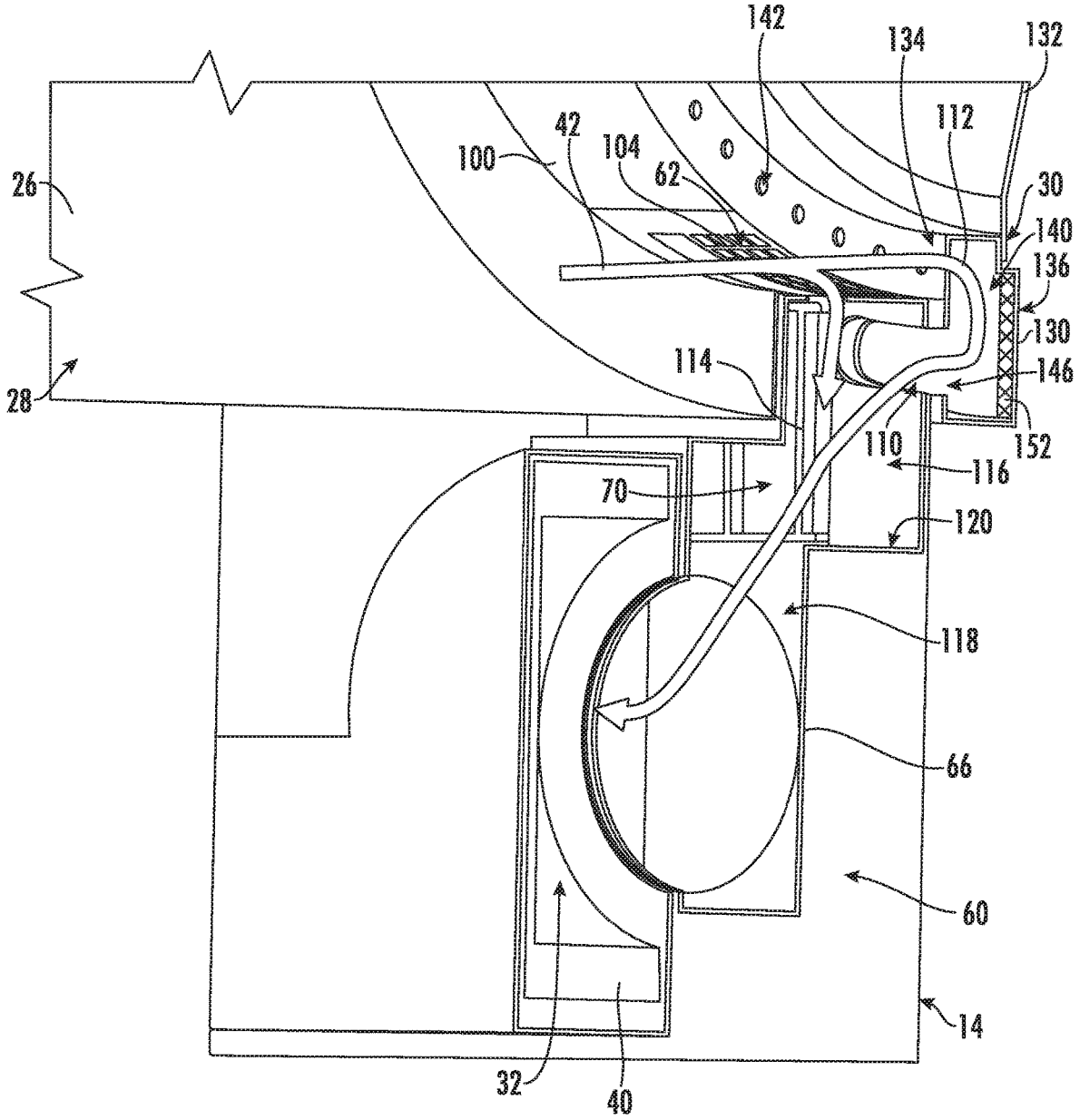
FIG. 4 provides a schematic perspective view of a door and a trap duct of the exemplary dryer appliance of FIG. 1 according to an exemplary embodiment of the present subject matter.

As best illustrated in FIGS. 3 and 4, dryer appliance 10 may further include a front bulkhead 100 which is positioned proximate front panel 14 and a front of drum 26. As illustrated, front bulkhead 100 defines an opening 102 through which chamber 28 may be accessed for adding or removing articles of clothing. As mentioned briefly above, door 30 is pivotally mounted to cabinet 12 to provide selective access to chamber 28 through opening 102. In addition, front bulkhead 100 defines chamber outlet 62 proximate a bottom of drum 26 along the vertical direction V. Chamber outlet 62 may be covered by a grill 104 to prevent articles of clothing from passing into trap duct 66. However, due to the position of chamber outlet 62, and the flow of air 42 through chamber outlet 62, articles of clothing may have a tendency to clog chamber outlet 62. Therefore, aspects of the present subject matter provide means for routing air 42 through chamber 28 and out through chamber outlet 62 or through door 30 (as explained below).

Specifically, according to the illustrated embodiment, front bulkhead 100 may further define a bypass aperture 110 through which bypass air (indicated by reference numeral 112) may pass into trap duct 66. In this regard, trap duct 66 may extend between air handler 32, chamber outlet 62, and bypass aperture 110. In addition, as described above, trap duct 66 may include a filter portion 70 which includes a lint filter 114 that divides trap duct 66 into an unfiltered region 116 and a filtered region 118. In this manner, air handler 32 may draw flow of air 42 and flow of bypass air 112 into the unfiltered region 116 through chamber outlet 62 and bypass aperture 110, respectively. Then, air handler 32 may draw the combined airflow through filter 114 where lint is removed before exhausting air through exhaust conduit 68 and out dryer discharge port 64.

Notably, trap duct 66 may further define a condensate collection reservoir 120 which is generally configured for collecting condensate upstream of air handler 32 and allowing that condensate to evaporate back into the air stream. For example, as illustrated, condensate collection reservoir 120 is defined at a bottom of unfiltered region 116 upstream of lint filter 114, e.g., at a bend or elbow defined in trap duct 66. In addition, according to exemplary embodiments, door 30 could be configured to drain, by gravity, into condensate collection reservoir 120.

Figure 5:
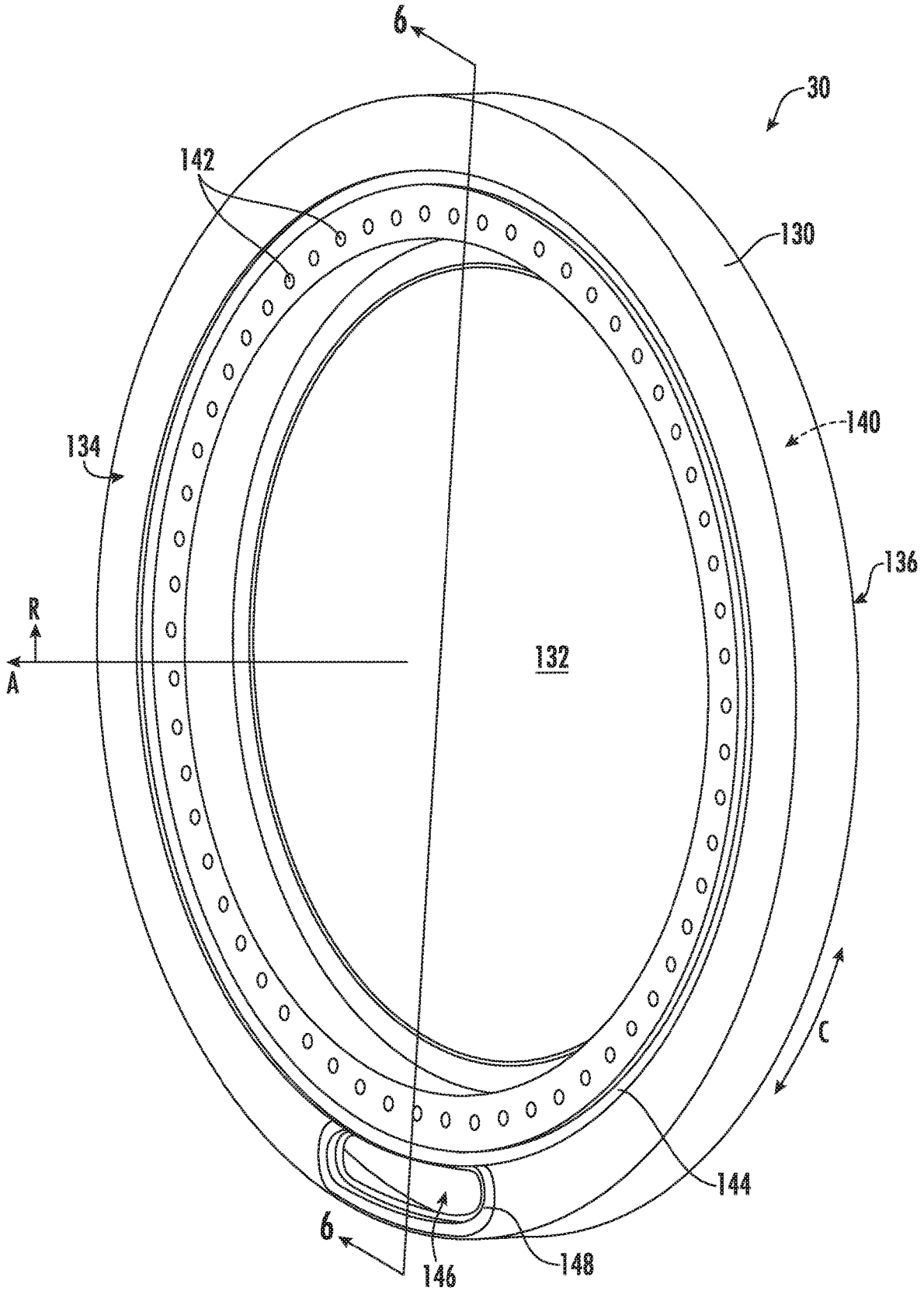
FIG. 5 provides a perspective view of the door of the exemplary dryer appliance of FIG. 1 according to an exemplary embodiment of the present subject matter.
Figure 6:
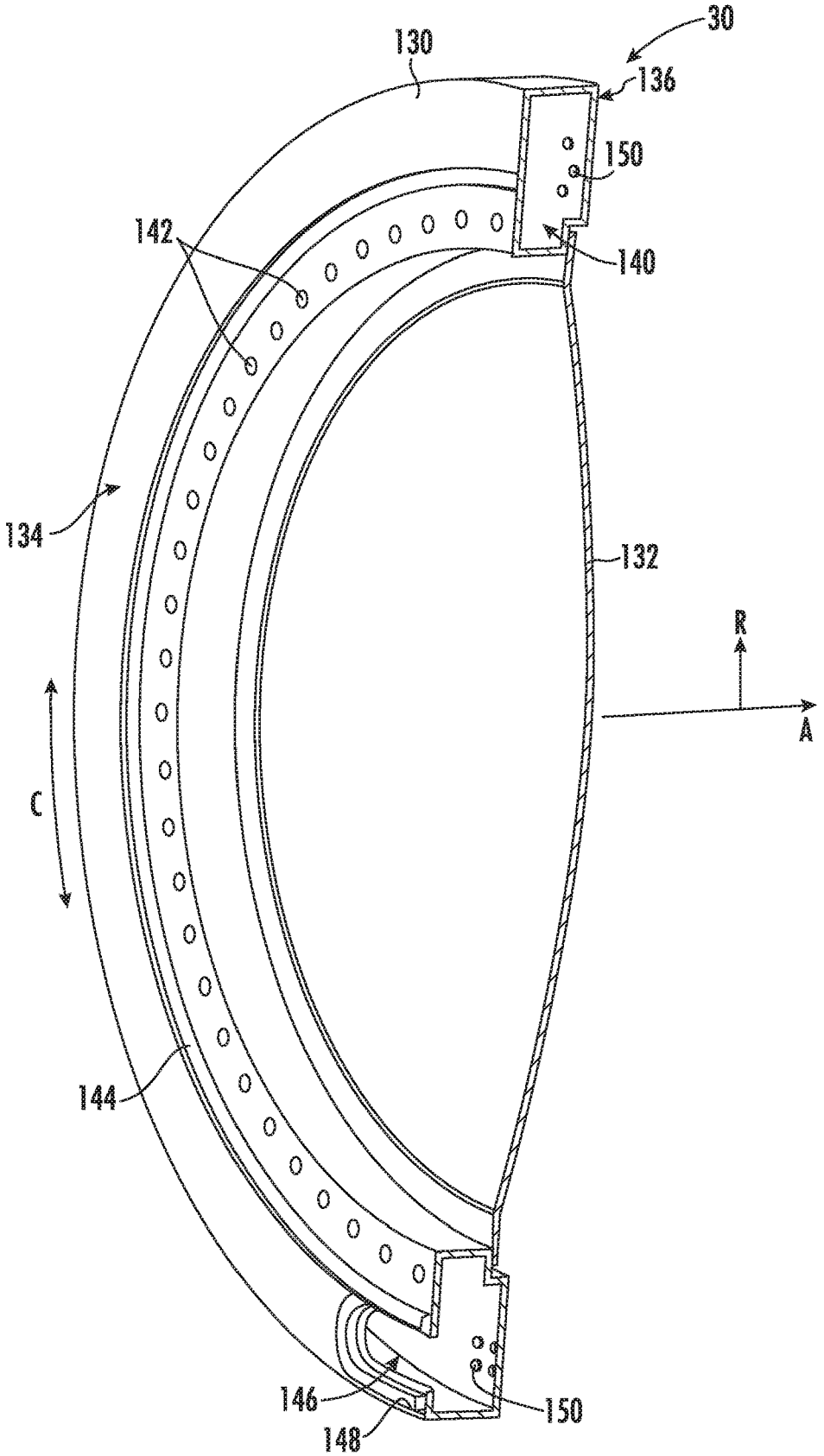
FIG. 6 is a cross sectional view of the door of the exemplary dryer appliance of FIG. 1, taken along Line 6-6 of FIG. 5.

Referring now specifically to FIGS. 4 through 6, door 30 will be described in more detail according to an exemplary embodiment of the present subject matter. According to an exemplary embodiment, door 30 may define an axial direction A, a radial direction R, and a circumferential direction C. In addition, door 30 may generally include a frame 130 and a transparent window 132 positioned within frame 130. Specifically, according to the illustrated embodiment, transparent window 132 includes one or more panes of glass or plastic and frame 130 has a substantially annular shape which is positioned over the opening 102 when door 30 is in the closed position.

As shown, frame 130 defines an inner surface 134 and a door outer surface 136 that are spaced apart along the axial direction A. Specifically, inner surface 134 faces chamber 28 and seals against one or more of cabinet 102, front panel 14, and/or front bulkhead 100 when door 30 is in the closed position. According to the illustrated embodiment, inner surface 134 is substantially flat and extends along the radial direction R. However, it should be appreciated that according to alternative embodiments, inner surface 134 may have any other suitable shape, size, or geometry suitable for engaging and sealing chamber 28 when door 30 is in the closed position.

As illustrated, frame 130 further defines a distribution plenum 140 that extends circumferentially around a perimeter of door 30. In addition, frame 130 defines a plurality of inlets 142 that are defined on inner surface 134 and generally provide direct fluid communication between chamber 28 and distribution plenum 140. Specifically, inlets 142 are spaced circumferentially around the frame 130 and are positioned inside a first resilient seal 144 that extends circumferentially around inner surface 134 of door 30. In this regard, first resilient seal 144 provides a fluid seal between a front bulkhead 100 and door 30, thereby permitting and directing the flow of bypass air 112 through inlets 142 and into distribution plenum 140. Although inlets 142 are illustrated as being defined in inner surface 134, it should be appreciated that they could be defined at any other suitable location on frame 130, such as along the inner circumferential surface of door frame 130 or at the location where transparent window 132 joins frame 130. In addition, it should be appreciated that according to exemplary embodiments, inlets 142 need not extend all the way around a circumference of frame 130.

In addition, frame 130 defines a plenum outlet 146 which is defined on inner surface 134 for providing direct fluid communication between distribution plenum 140 and bypass aperture 110 of front bulkhead 100. Specifically, plenum outlet 146 is positioned proximate the bottom of frame 130 and outside inlets 142 along the radial direction R. In addition, plenum outlet 146 is aligned with bypass aperture 110 when door 30 is in the closed position and is surrounded by a second circumferential seal 148 to provide fluid seal between door 30 and front bulkhead 100 around bypass aperture 110. Although bypass aperture 110 and plenum outlet 146 are illustrated at the bottom of frame 130, it should be appreciated that they may be positioned at any other suitable location, such as out of a top corner of drum 26 in embodiments where the flow of air 42 is returned to chamber 28 after passing through a heat pump dehumidification system. Alternatively, plenum outlet 146 could be defined on an outer circumferential surface of frame 130 or at any other suitable location outside first resilient seal 144.

During operation of dryer appliance 10, air handler 32 draws the flow of air 42 into chamber 28 through chamber inlet 58. The air 42 may flow uniformly through chamber 28 toward door 30 to provide improved and more uniform drying of articles of clothing positioned within chamber 28. A portion of the flow of air 42 may pass through chamber outlet 62 into trap duct 66 while another portion, referred to herein as bypass air 112, may flow through inlets 142 into distribution plenum 140. The flow of bypass air 112 may then flow through annular distribution plenum 140 down toward plenum outlet 146 before passing through bypass aperture 110 into trap duct 66. In this manner, even in the event that an article of clothing clogs chamber outlet 62, the flow of bypass air 112 may still ensure proper dryer performance.

As best shown in FIG. 6, frame 130 may further define features for reducing the likelihood of lint build up. In this regard, frame 130 may generally be formed from a smooth material that does not promote lint build up. In addition, inlets 142 and plenum outlet 146 may be sized properly to promote an ideal flow velocity which can reduce or eliminate the collection of lint. Moreover, frame 130 may define localized features, such as protrusions 150 (FIG. 6) that are used to generate turbulence intended to clean lint from problem surfaces within frame 130.

In addition, as shown for example in FIG. 4, door 30 may include insulation 152 to keep the temperature of door outer surface 136 below acceptable temperatures and to minimize condensation within frame 130. In this regard, for example, insulation layer 152 may be positioned between distribution plenum 140 and outer surface 136. Notably, the bypass air 112 which enters distribution plenum 140 will be saturated and any drop in temperature will result in condensation. Thus, by including insulation 152, the likelihood of bypass air 112 being exposed to lower temperatures will be reduced. In addition, frame 130 may define features for facilitating the flow of any condensate out of frame 130, e.g., and directing that condensate into condensate collection reservoir 120 within trap duct 66. Other features are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for receipt of clothes for drying;

a front bulkhead fixed relative to the cabinet and defining a bypass aperture and an opening for accessing the chamber;

a door pivotally mounted to the cabinet over the opening to provide selective access to the chamber, the door comprising:

a frame defining an inner surface and a distribution plenum, the distribution plenum being defined within the frame;

a plurality of inlets defined on the inner surface for providing fluid communication between the chamber and the distribution plenum;

a plenum outlet defined on the inner surface for providing fluid communication between the distribution plenum and the bypass aperture; and a transparent window positioned within the frame.

2. The dryer appliance of claim 1, wherein the plurality of inlets are spaced circumferentially around the frame.

3. The dryer appliance of claim 1, wherein the plenum outlet is positioned outside the plurality of inlets along a radial direction.

4. The dryer appliance of claim 3, wherein the plenum outlet is defined proximate a bottom of the frame.

5. The dryer appliance of claim 1, wherein the frame defines one or more surface aberrations within the distribution plenum to generate turbulence and prevent lint build-up.

6. The dryer appliance of claim 1, wherein the door comprises a resilient seal placed on the inner surface of the door around the plurality of inlet apertures and around the plenum outlet to provide a seal between the door and the cabinet.

7. The dryer appliance of claim 1, wherein the transparent window comprises glass.

8. The dryer appliance of claim 1, wherein the frame and the distribution plenum are annular.

9. The dryer appliance of claim 1, wherein the frame comprises an insulation layer positioned between the distribution plenum and a door outer surface.

10. The dryer appliance of claim 1, wherein the front bulkhead defines a chamber outlet in fluid communication with the chamber, the chamber outlet being covered by a grill.

11. The dryer appliance of claim 1, comprising:

a trap duct in fluid communication with the chamber at the bypass aperture;

an air handler operably coupled to the trap duct for urging a flow of air through the trap duct.

12. The dryer appliance of claim 11, wherein the drum defines a chamber inlet in a rear of the drum, the air handler being configured for urging the flow of air from the chamber inlet to the bypass aperture.

13. The dryer appliance of claim 11, wherein the trap duct defines a condensate collection reservoir.

14. The dryer appliance of claim 11, wherein the trap duct comprises a lint filter, and wherein the flow of air passes through the distribution plenum, into the trap duct, and through the lint filter.

15. The dryer appliance of claim 11, wherein the air handler is a blower unit positioned downstream of the trap duct.

16. A door of a dryer appliance, the dryer appliance comprising a drum defining a chamber for receipt of clothes for drying and a front bulkhead fixed relative to the cabinet and defining a bypass aperture and an opening for accessing the chamber, the door comprising:

a frame defining an inner surface and a distribution plenum, the distribution plenum being defined within the frame;

a plurality of inlets defined on the inner surface for providing fluid communication between the chamber and the distribution plenum;

a plenum outlet defined on the inner surface for providing fluid communication between the distribution plenum and the bypass aperture; and a transparent window positioned within the frame.

17. The door of claim 16, wherein the plenum outlet is positioned proximate a bottom of the frame and outside the plurality of inlets along a radial direction.

18. The door of claim 16, wherein the frame comprises an insulation layer positioned between the distribution plenum and a door outer surface.

19. The door of claim 16, comprising:

a trap duct in fluid communication with the chamber at the bypass aperture;

an air handler operably coupled to the trap duct for urging a flow of air through the trap duct.

20. The door of claim 19, wherein the front bulkhead defines a chamber outlet in fluid communication with the chamber, the chamber outlet being covered by a grill, and wherein the drum defines a chamber inlet in a rear of the drum, the air handler being configured for urging the flow of air from the chamber inlet to the bypass aperture and the chamber outlet.

* * * * *